US009655408B1

(12) United States Patent
Marti

(10) Patent No.: US 9,655,408 B1
(45) Date of Patent: May 23, 2017

(54) CHARM ATTACHMENT FOR A SHOE HEEL

(71) Applicant: Tia L. Marti, Thornton, CO (US)

(72) Inventor: Tia L. Marti, Thornton, CO (US)

( * ) Notice: Subject to any disclaimer, the term of this patent is extended or adjusted under 35 U.S.C. 154(b) by 688 days.

(21) Appl. No.: 14/150,945

(22) Filed: Jan. 9, 2014

(51) Int. Cl.
*A43B 23/00* (2006.01)
*A43B 23/24* (2006.01)
*A43B 3/00* (2006.01)
*A43C 11/24* (2006.01)

(52) U.S. Cl.
CPC ..... *A43B 23/24* (2013.01); *A43B 3/0078* (2013.01); *A43C 11/24* (2013.01)

(58) Field of Classification Search
CPC ..... A43B 23/24; A43B 3/0078; A43C 11/16; A43C 11/24; F16B 21/084; F16B 11/086
USPC ..... 36/136; 2/245
See application file for complete search history.

(56) References Cited

U.S. PATENT DOCUMENTS 2,792,656 A * 5/1957 Glagovsky ..... A44C 15/00 24/3.1
4,724,628 A 2/1988 Schreiner
5,630,289 A * 5/1997 Dotson ..... A01K 85/00 43/42.09
5,673,501 A 10/1997 Mathews
6,099,921 A * 8/2000 Schmidt ..... A01G 5/04 156/61
8,069,538 B2 12/2011 Wilcox
8,230,639 B2 * 7/2012 Langer ..... A01K 85/00 43/42.11
8,516,725 B1 * 8/2013 George ..... A43C 11/16 24/714.8
2012/0042544 A1 * 2/2012 Leo ..... A43B 23/24 36/136

* cited by examiner

*Primary Examiner* — Jameson Collier
(74) *Attorney, Agent, or Firm* — Stevenson IP, LLC

(57) ABSTRACT

A charm attachment for a shoe heel to removably attach at least one charm to a rear side of a shoe heel including a cylindrical anchor member and V-shaped pairs of barbs to secure the anchor member onto the shoe heel. A charm engagement member of the anchor member disposed on the rearward end is configured to retain at least one charm on the central body proximal the shoe heel and is spiral shaped to prevent slippage of each charm from the anchor member and to provide a grip by which to insert the anchor member into the shoe heel. A stopper member, which is disposed on the central body between the at least one charm disposed on the central body and one of the pair of barbs most proximal the rearward end, allows the anchor member to be inserted only to the stopper member's location on the central body.

7 Claims, 4 Drawing Sheets

CHARM ATTACHMENT FOR A SHOE HEEL

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of charm attachment for a shoe heel are known in the prior art. However, a secure mechanism for attachment of a charm to a shoe heel is what is needed to prevent loss of the charm from the wearer's shoe during normal daily activities. The charm must also be detachable to accommodate the substitution of a variety of charms. What has been needed is a charm attachment for a shoe heel that is secure, removable, reusable, and provides for the removal and substitution of a variety of shapes and sizes of charm attachments, while being cost effective.

The ideal device should provide for a removable attachment of the charm to the charm attachment. The ideal device should provide a secure mechanism of attachment to the shoe heel to prevent loss of the charm and charm attachment during the normal daily activities of the wearer. The ideal device should provide for a multiplicity of sizes and shapes of charms to provide for interchangeability of charm attachments. The ideal device should provide for attachment of at least one charm attachment and for insertion of an anchor member without destroying the shoe. The ideal device should provide for a stopper to prevent excessive penetration of the charm attachment upon insertion into the heel. The present device accomplishes these goals. The present apparatus provides a combination of features not heretofore provided in accessories for a charm attachment for a shoe heel.

FIELD OF THE INVENTION

The present invention relates to shoe accessories, and in particular, a charm attachment for a shoe heel.

SUMMARY OF THE INVENTION

The general purpose of the present charm attachment for a sole heel, described subsequently in greater detail, is to permit the interchangeable attachment of at least one charm to anchor member inserted into a shoe sole.

To accomplish this, the present charm attachment for a shoe heel includes a cylindrical anchor member and a plurality of pairs of V-shaped barbs disposed on the forward end and on the central body of the anchor member proximal the forward end a. Each pair of barbs has an apex directed toward the forward end. A charm engagement member, which forms part of the anchor member, is disposed on the rearward end and is configured to retain at least one charm on the central body between the charm engagement member and the rear side of a shoe heel. The charm engagement member is a spiral with at least one and one-half loops to prevent each charm from slipping from the central body, allows more than one of the at least one charm to be retained on the central body, while accommodating the interchangeability of charms. The charm engagement member also provides a gripping surface by which gripping of the anchor member is enhanced for insertion into the shoe heel. The anchor member is configured to insert into the shoe heel in a position perpendicular thereto. The barbs are configured to secure the anchor member to the shoe heel.

A stopper member, is disposed on the central body between the at least one charm disposed on the central body and one of the pair of barbs most proximal the rearward end and between the at least one charm and the shoe heel. The stopper member allows the anchor member to be inserted only to the point at which the stopper member is disposed on the central body. The stopper member is a disc; however, the stopper member can be any other shape that promotes the functionality of the present device.

In use, each charm is threaded onto the charm engagement member from an external tip of the charm engagement member toward the stopper member and is removed by reversing this procedure.

The charm attachment for a shoe heel is variable in size to provide for different sizes of shoe heels and to accommodate different sizes and numbers of charms. The charm attachment for a shoe heel can be formed of metal and other materials that promote the purposes of the present device can be employed. Although the present device is directed to attachment of charms to a shoe heel rear side, the device is also employed to attach charms elsewhere in the shoe outsole.

The present device has a multitude of uses for display and securing of jewelry during activities requiring walking or other physical activities. Thus has been broadly outlined the more important features of the present charm attachment for a shoe heel so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
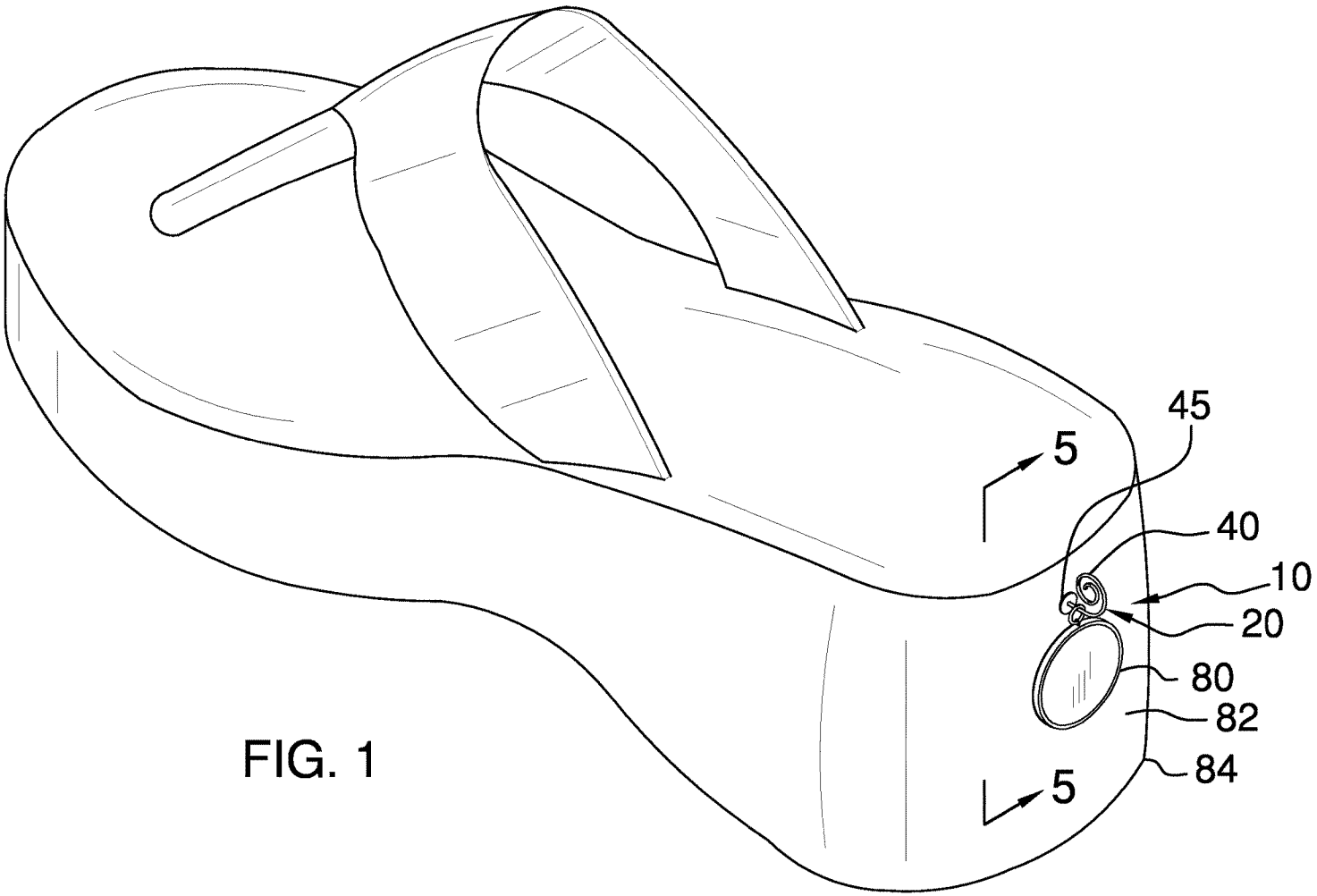
FIG. 1 is an in use isometric view.
Figure 2:
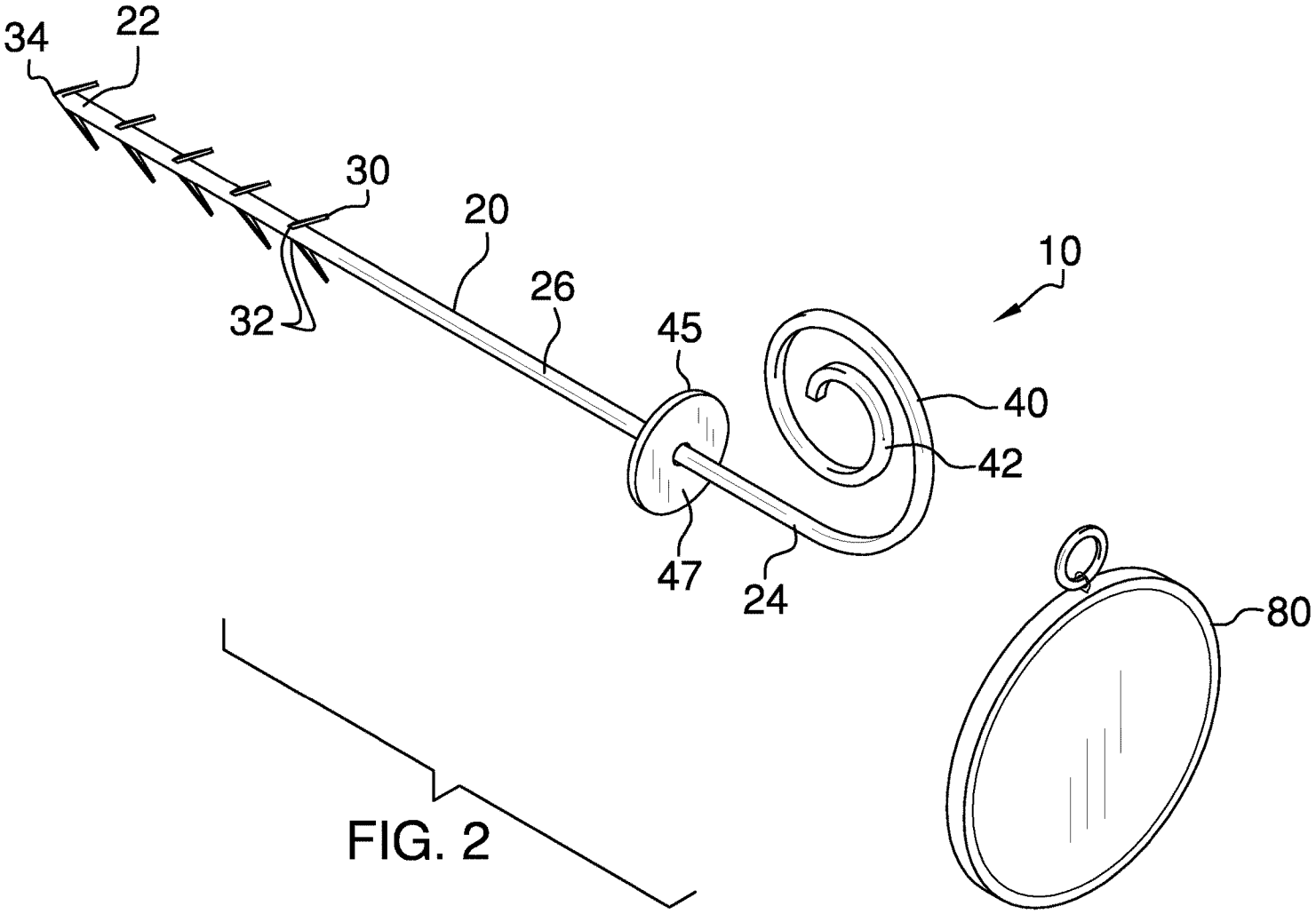
FIG. 2 is an isometric view.
Figure 3:
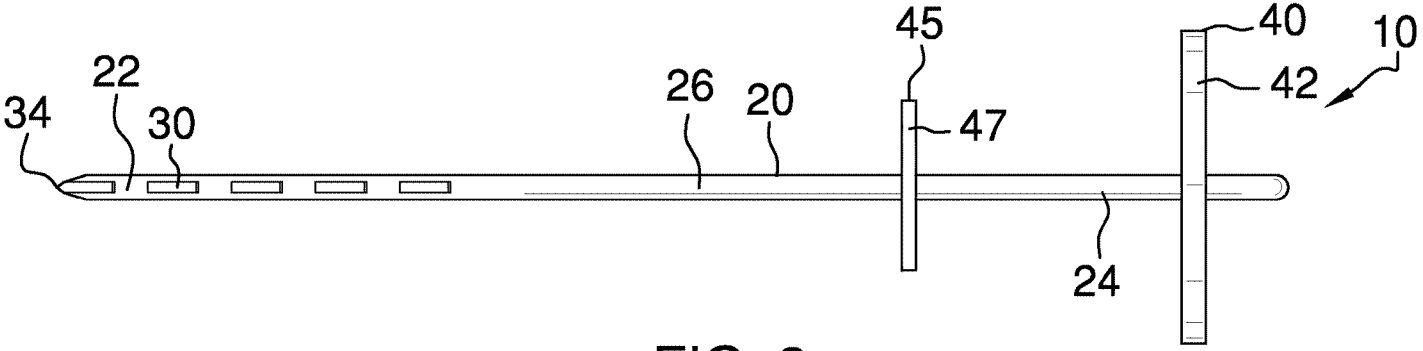
FIG. 3 is a side elevation view.
Figure 4:
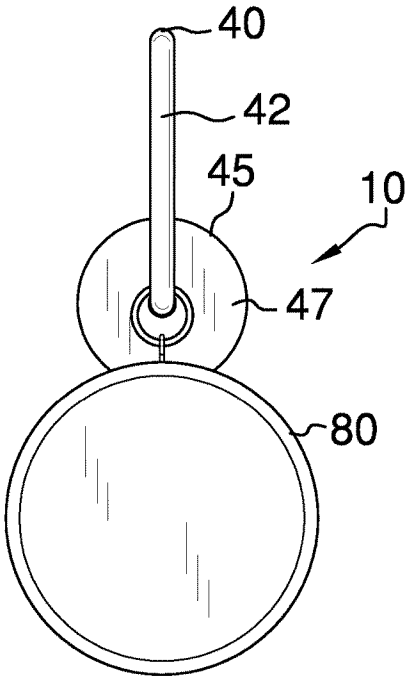
FIG. 4 is an in-use rear elevation view showing a charm attached to an anchor member.
Figure 5:
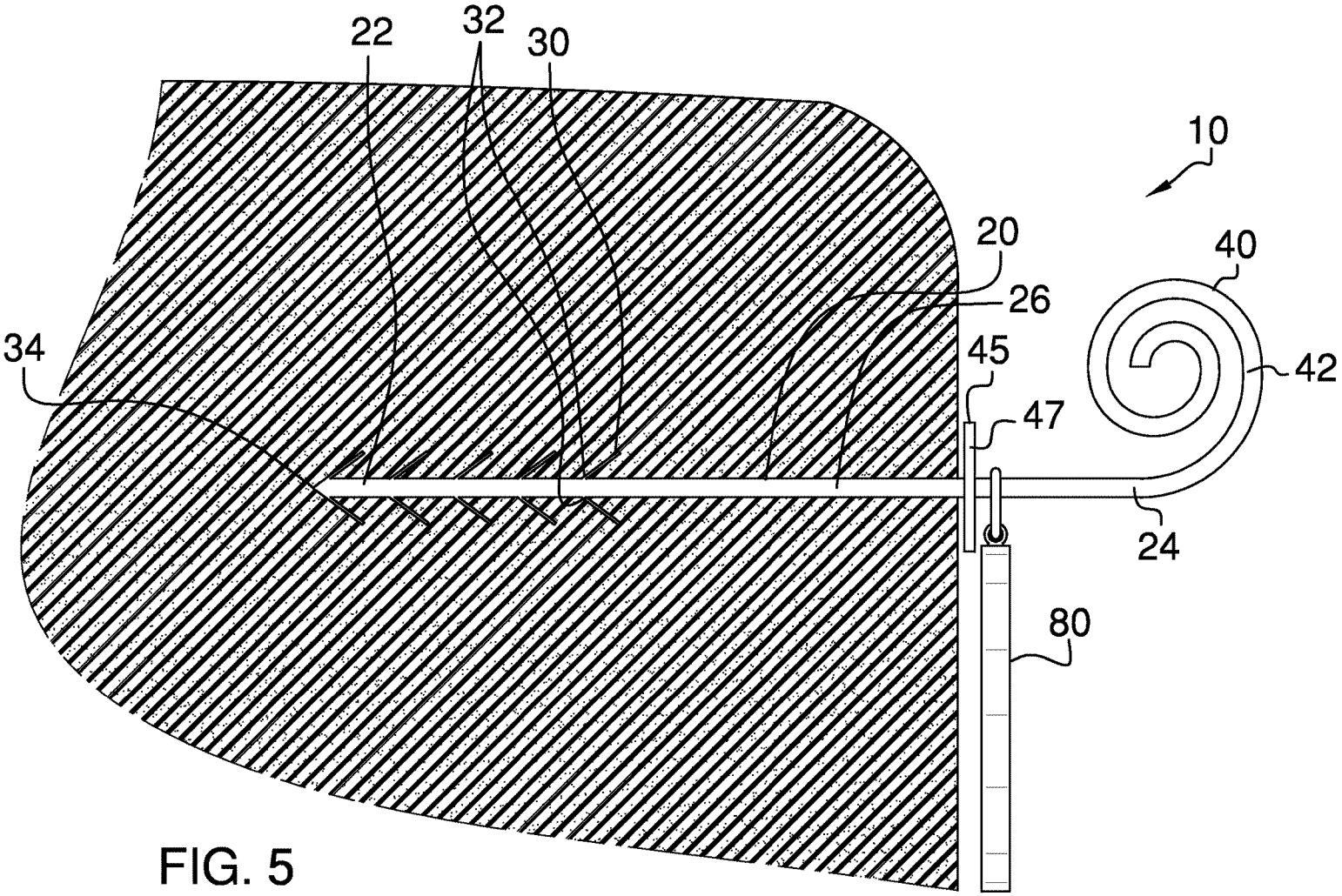
FIG. 5 is a partial cross sectional view taken along line 5-5 of FIG. 4 showing a forward end of a central body of an anchor member inserted into a rear side of a shoe heel.

With reference now to the drawings, and in particular FIGS. 1 through 5 thereof, an example of the charm attachment for a shole heel employing the principles and concepts of the present charm attachment for a shoe heel and generally designated by the reference number 10 will be described.

Referring to FIGS. 1 through 5, the present charm attachment for a shoe heel is illustrated. The instant device 10 includes a cylindrical anchor member 20 having a forward end 22, a rearward end 24, and a central body 26 disposed between the forward end 22 and the rearward end 24. A plurality of barbs 30 is disposed on the forward end 22 and on the central body 26 proximal the forward end 22. The barbs 30 are arranged in V-shaped pairs 32. Each V-shaped pair 32 of barbs 30 has an apex 34 directed toward the forward end 22.

A charm engagement member 40 forms part of the anchor member 20 and is disposed on the rearward end 24. The charm engagement member 40 is configured to retain at least one charm 80 on the central body 26 between the charm engagement member 40 and the heel 81, including a rear side 82 of a shoe heel 84 as shown in the FIGS. 1 and 5. The charm engagement member 40 is a spiral 42 with at least one and one-half loops. Although the charm engagement member 40 could be another shape that will retain the at least one charm 80 on the central body 26, the spiral 42 prevents each charm 80 from slipping from the central body 26, allows more than one of the at least one charm 80 to be retained on the central body 26, while also accommodating the interchangeability of charms 80. The charm engagement member 40 also provides a gripping surface by which gripping of the anchor member 20 is enhanced for insertion into the shoe heel 84.

A stopper member 45, which prevents excessive penetration into the heel of the shoe, is disposed on the central body 26 between the at least one charm 80 disposed on the central body 26 and one of the pair 32 of barbs 30 most proximal the rearward end 24. The stopper member 45 is further configured to be disposed between the at least one charm 80 and the rear side 82 of the shoe heel 84. The stopper member 45 is configured to allow the anchor member 20 to be inserted only to the point at which the stopper member 45 is disposed on the central body 26. The stopper member 45 is a disc 47; however, the stopper member 45 can be any other shape that promotes the functionality of the present device 10.

The anchor member 20 is configured to insert into the rear side 82 of the shoe heel 84 in a position perpendicular to the rear side 82 of the shoe heel 84. The barbs 30 are configured to secure the anchor member 20 to the shoe heel 84.

What is claimed is:

1. A charm attachment assembly comprising:

a shoe heel, a cylindrical anchor member insertable into the shoe and having a forward end, a rearward end, and a central body disposed between the forward end and the rearward end;

a plurality of barbs disposed on the forward end and on the central body proximal to the forward end, the barbs being arranged in V-shaped pairs, each V-shaped pair of barbs having an apex directed toward the forward end; and the anchor member further comprises a charm engagement member at the rearward end, the charm engagement member being disposed on the rearward end, the charm engagement member configured to retain one or more charms on the central body between the charm engagement member and a rear side of the shoe heel;

wherein the anchor member is configured to insert into the rear side of the shoe heel in a position perpendicular to the rear side of the shoe heel; and wherein the barbs are configured to secure the anchor member to the shoe heel.

2. The charm attachment assembly of claim 1 further comprising: one or more charms disposed on the central body;

a stopper member having a central aperture therein, the stopper member disposed on the central body between the one or more charms and the pair of barbs most proximate to the rearward end; and wherein the stopper member is configured to be further disposed between the one or more charms and the rear side of the shoe heel.

3. The charm attachment assembly of claim 2 wherein the stopper is a disc.

4. A charm attachment assembly comprising:

a shoe heel, one or more charms;

a cylindrical anchor member insertable into the shoe heel and having a forward end, a rearward end, and a central body disposed between the forward end and the rearward end;

a plurality of barbs disposed on the forward end and on the central body proximal to the forward end, the barbs being arranged in V-shaped pairs, each V-shaped pair of barbs having an apex directed toward the forward end;

the anchor member further comprises a charm engagement member, the charm engagement member being disposed on the rearward end, the charm engagement member configured to retain the one or more charms on the central body between the charm engagement member and a rear side of the shoe heel; wherein the charm engagement member is a spiral; and wherein the anchor member is configured to insert into the rear side of the shoe heel in a position perpendicular to the rear side of the shoe heel;

wherein the barbs are configured to secure the anchor member to the shoe heel; and wherein the stopper member is configured to be further disposed between the one or more charms and the rear side of the shoe heel.

5. The charm attachment assembly of claim 4 wherein the spiral has at least one and one-half loops.

6. The charm attachment assembly of claim 5 wherein the stopper member is a disc.

7. The charm attachment assembly of claim 4 wherein the stopper member is a disc.

* * * * *